US009673517B2

(12) United States Patent
Tran et al.

(10) Patent No.: US 9,673,517 B2
(45) Date of Patent: Jun. 6, 2017

(54) VEHICLE RADAR COVER ASSEMBLY AND METHOD

(71) Applicant: Honda Motor Co., Ltd., Tokyo (JP)

(72) Inventors: Trung P. Tran, Lewis Center, OH (US); Victor D. Flores, Dublin, OH (US); Justin Yerkes, Marysville, OH (US); Darin S. Garrett, Delaware, OH (US)

(73) Assignee: Honda Motor Co., Ltd., Tokyo (JP)

( * ) Notice: Subject to any disclaimer, the term of this patent is extended or adjusted under 35 U.S.C. 154(b) by 168 days.

(21) Appl. No.: 14/265,832

(22) Filed: Apr. 30, 2014

(65) Prior Publication Data

US 2015/0318608 A1 Nov. 5, 2015

(51) Int. Cl.
*H01Q 1/42* (2006.01)
*H01Q 1/32* (2006.01)
*H01Q 1/12* (2006.01)

(52) U.S. Cl.
CPC ..... *H01Q 1/42* (2013.01); *H01Q 1/1207* (2013.01); *H01Q 1/3233* (2013.01); *H01Q 1/3283* (2013.01); *Y10T 29/49897* (2015.01)

(58) Field of Classification Search
CPC ..... H01Q 1/3233; H01Q 1/42; H01Q 1/405; H01Q 1/32
USPC ..... 343/872, 713, 711, 712
See application file for complete search history.

(56) References Cited

U.S. PATENT DOCUMENTS 5,585,809 A 12/1996 Yajima et al.
5,689,276 A * 11/1997 Uematsu ..... H01Q 1/3275 343/713
5,757,327 A 5/1998 Yajima et al.
5,900,840 A 5/1999 Yajima
5,926,142 A * 7/1999 Rathgeb ..... B60C 23/0444 343/711
6,157,294 A * 12/2000 Urai ..... B60Q 1/52 307/10.1
6,489,927 B2 * 12/2002 LeBlanc ..... B60K 31/0008 342/198
6,496,138 B1 * 12/2002 Honma ..... G01S 13/931 342/27
6,744,399 B2 * 6/2004 Tohyama ..... G01S 7/4026 342/165
6,773,018 B2 8/2004 Gomez
6,828,931 B2 * 12/2004 Kikuchi ..... G01S 7/4026 342/174
6,930,643 B2 8/2005 Byrne et al.
(Continued)

FOREIGN PATENT DOCUMENTS

DE 102011115952 4/2013
DE 102012104090 11/2013

*Primary Examiner* — Dameon E Levi
*Assistant Examiner* — Ab Salam Alkassim, Jr.
(74) *Attorney, Agent, or Firm* — Rankin, Hill & Clark LLP

(57) ABSTRACT

A vehicle radar cover assembly and method includes a radar bracket for securing a radar unit to the vehicle, a radar cover for inhibiting undesirable matter from interfering with the radar unit, and at least one fastener securing both the radar bracket and the radar cover to the vehicle. The radar bracket includes at least one bracket mounting aperture. The radar cover includes at least one cover mounting aperture. The at least one fastener is received through aligned ones of the at least one bracket mounting aperture and the at least cover mounting aperture.

18 Claims, 10 Drawing Sheets

(56) References Cited

U.S. PATENT DOCUMENTS 7,119,735 B2 10/2006 Hirose et al.
7,126,525 B2 * 10/2006 Suzuki ..... G01S 7/03 342/1
7,148,838 B2 * 12/2006 Kakishita ..... G01S 7/03 342/175
7,397,436 B2 7/2008 Noro et al.
7,466,280 B2 12/2008 Noro et al.
7,508,353 B2 * 3/2009 Shingyoji ..... H01Q 1/3233 342/1
7,675,460 B2 3/2010 Sanada
7,705,794 B2 * 4/2010 Shimura ..... B60C 23/0408 343/713
7,710,312 B2 * 5/2010 Kato ..... G01S 7/034 342/175
7,755,551 B2 7/2010 Lindackers et al.
7,768,465 B2 * 8/2010 Jared ..... H01Q 1/1214 343/713
7,988,212 B2 * 8/2011 Hartley ..... B60R 19/483 293/117
7,990,334 B2 8/2011 Maeda et al.
8,026,864 B2 9/2011 Noro et al.
8,149,157 B2 4/2012 Takeuchi
8,368,587 B2 2/2013 Takeuchi
8,527,151 B2 9/2013 Le et al.
8,576,138 B2 * 11/2013 Suzuki ..... H01Q 1/3266 343/713
8,833,815 B2 * 9/2014 Aleem ..... B60R 19/483 293/102
8,973,278 B2 * 3/2015 Ham ..... G01B 5/24 33/286
9,024,804 B2 * 5/2015 Shi ..... G01S 13/867 342/175
9,110,162 B2 * 8/2015 Matsuzawa ..... H01Q 1/3233
2003/0155474 A1 * 8/2003 Dean ..... G11B 33/124 248/300
2004/0017308 A1 * 1/2004 Kikuchi ..... G01S 7/4026 342/74
2004/0239574 A1 * 12/2004 Zeiher ..... B60R 19/483 343/757
2005/0068248 A1 * 3/2005 Yoneya ..... H01Q 1/02 343/872
2005/0110701 A1 5/2005 Li
2006/0238404 A1 10/2006 Ikeda
2007/0229382 A1 * 10/2007 Rupp ..... H01Q 1/42 343/789
2009/0146865 A1 * 6/2009 Watanabe ..... G01S 13/50 342/27
2011/0047784 A1 3/2011 Ohtake et al.
2012/0326915 A1 * 12/2012 Hill ..... G01S 13/9303 342/30
2013/0050034 A1 * 2/2013 Wu ..... H01Q 1/3233 343/713
2013/0141269 A1 * 6/2013 Schneider ..... H01Q 1/3233 342/70
2014/0299644 A1 * 10/2014 Aleem ..... B60R 9/06 224/555
2014/0375490 A1 * 12/2014 Pfitzenmaier ..... G01S 7/032 342/4
2015/0260827 A1 * 9/2015 Hansen ..... B60J 1/20 343/872

* cited by examiner

VEHICLE RADAR COVER ASSEMBLY AND METHOD

BACKGROUND

One feature sometimes provided in modern vehicles is a radar for detecting vehicles or other objects in the driver's blind spot. For example, some vehicles come equipped with radar units installed under the rear bumper cover on lateral sides of the vehicle (i.e., under the portions of the rear bumper cover that wrap around onto the lateral sides of the vehicle). These radars detect the presence of other vehicles or objects in adjacent zones, portions of which are sometimes within or likely to be within a driver's blind spot. The radar units are operatively connected to a control system that alerts the driver (e.g., visually and/or audibly) that a vehicle or other object is detected by the radar units.

Typically, the radar units are disposed under a bumper cover of the vehicle. To function properly, the radar unit should have a clean surface and no obstructions between its forward working surface and the bumper cover. While the bumper cover inhibits most debris and/or other particles from interfering with the radar unit, over time some such debris and/or particles (e.g., snow, mud, etc.) can work its way beneath the bumper cover and between the working surface of the radar unit and the bumper cover. This increases the likelihood of the radar unit not functioning properly.

SUMMARY

According to one aspect, a radar cover assembly for a vehicle includes a radar bracket for securing a radar unit to the vehicle, a radar cover for inhibiting undesirable matter from interfering with the radar unit, and at least one fastener securing both the radar bracket and the radar cover to the vehicle. The radar bracket includes at least one bracket mounting aperture. The radar cover includes at least one cover mounting aperture. The at least one fastener is received through aligned ones of the at least one bracket mounting aperture and the at least cover mounting aperture.

According to another aspect, a vehicle radar cover assembly includes a radar bracket having one or more mounting apertures for securing a radar unit to an underside vehicle surface and a radar cover enveloping the radar bracket. The radar cover has one or more cover mounting apertures for securing the radar cover to the underside vehicle surface. The vehicle radar cover assembly further includes one or more fasteners received through the one or more mounting apertures and the one or more cover mounting apertures so that each of the one or more fasteners secures both the radar bracket and the radar cover to the underside vehicle surface.

According to a further aspect, a vehicle radar cover method includes providing a radar bracket for securing a radar unit to a vehicle underside surface, wherein the radar bracket includes at least one bracket mounting aperture. The method also includes providing a radar cover for inhibiting undesirable matter from interfering with the radar unit, wherein the radar cover includes at least one cover mounting aperture. The method further includes installing a fastener through aligned ones of the least one bracket mounting aperture and the at least one cover mounting aperture to simultaneously secure both the radar bracket and the radar cover to the underside vehicle surface.

DETAILED DESCRIPTION

Figure 10:
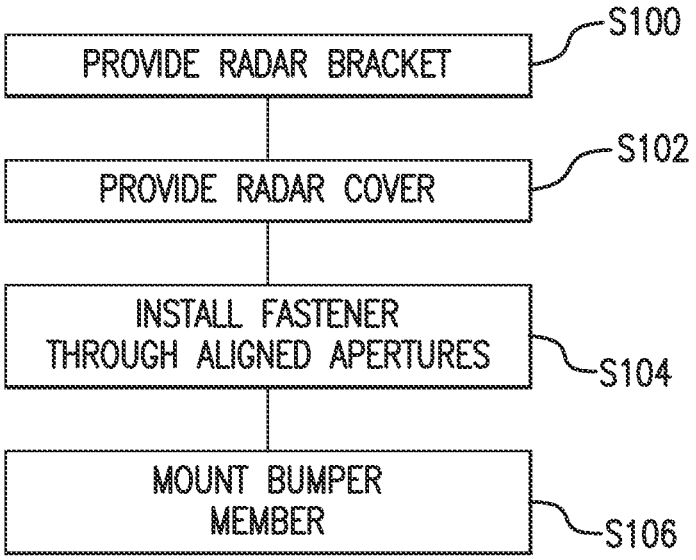
FIG. 10 is a flow diagram illustrating a vehicle radar cover method according to an exemplary embodiment.
Figure 11:
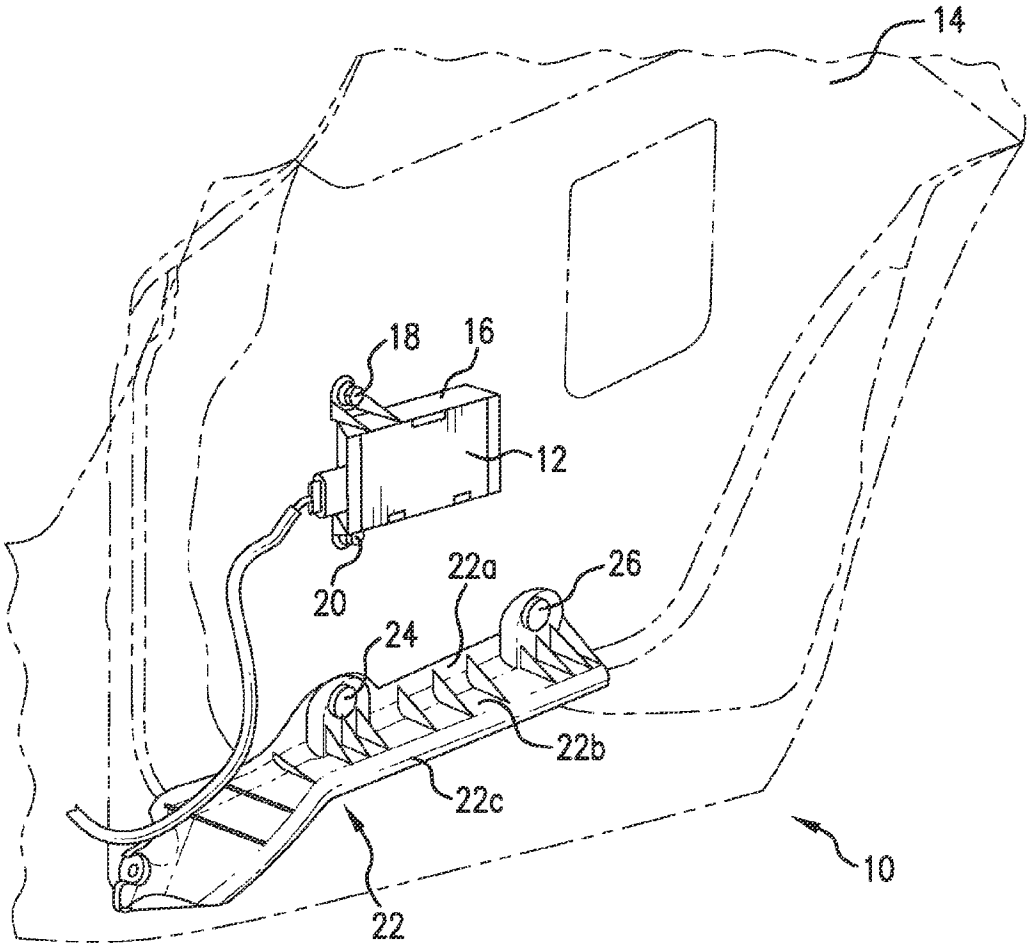
FIG. 11 (Prior Art)
FIG. 11 is a partial perspective view of a radar unit and a blocking member according to a known design.

With reference now to FIG. 11, a known radar mounting arrangement is illustrated generally by reference numeral 10. As shown, a radar unit 12 is secured to a vehicle 14 by a radar bracket 16. In particular, the radar bracket 16 is secured to the vehicle 14 by a pair of fasteners 18, 20 (e.g., bolts). Separately, a blocking member 22 is secured to the vehicle 14 by a plurality of fasteners 24, 26 (only two shown in FIG. 10). More specifically, the blocking member 22 is secured to the vehicle 14 at a vertically spaced apart location from the radar unit 12 and radar bracket 16. The blocking member 22 includes a mounting portion 22*a* that is secured against the vehicle 14 and an extending portion 22*b* projecting from the mounting portion 22*a* outwardly away from the vehicle 14. Though not shown, a distal edge 22*c* of the extending portion 22*b* can be in contact with or positioned adjacent a bumper member (not shown) that overlays the blocking member 22 and the radar unit 12. The function of the blocking member 22 is to inhibit debris and/or other particulate matter (e.g., snow, mud, dirt, etc.) from reaching the radar unit 12 and interfering with proper operation of the radar unit 12.

Figure 1:
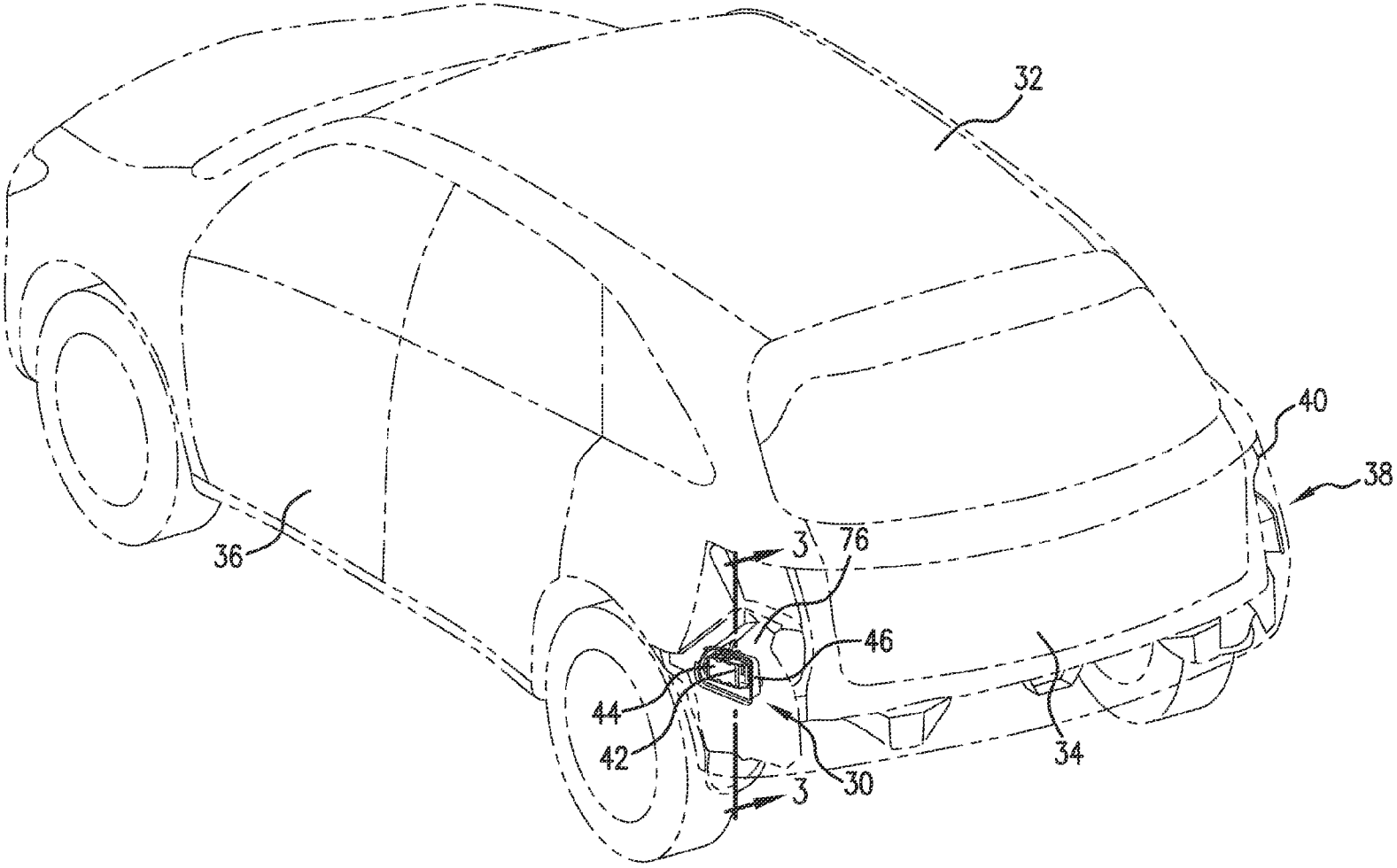
FIG. 1 is a perspective view of a vehicle having a radar cover assembly installed on each lateral side of the vehicle according to an exemplary embodiment.
Figure 2:
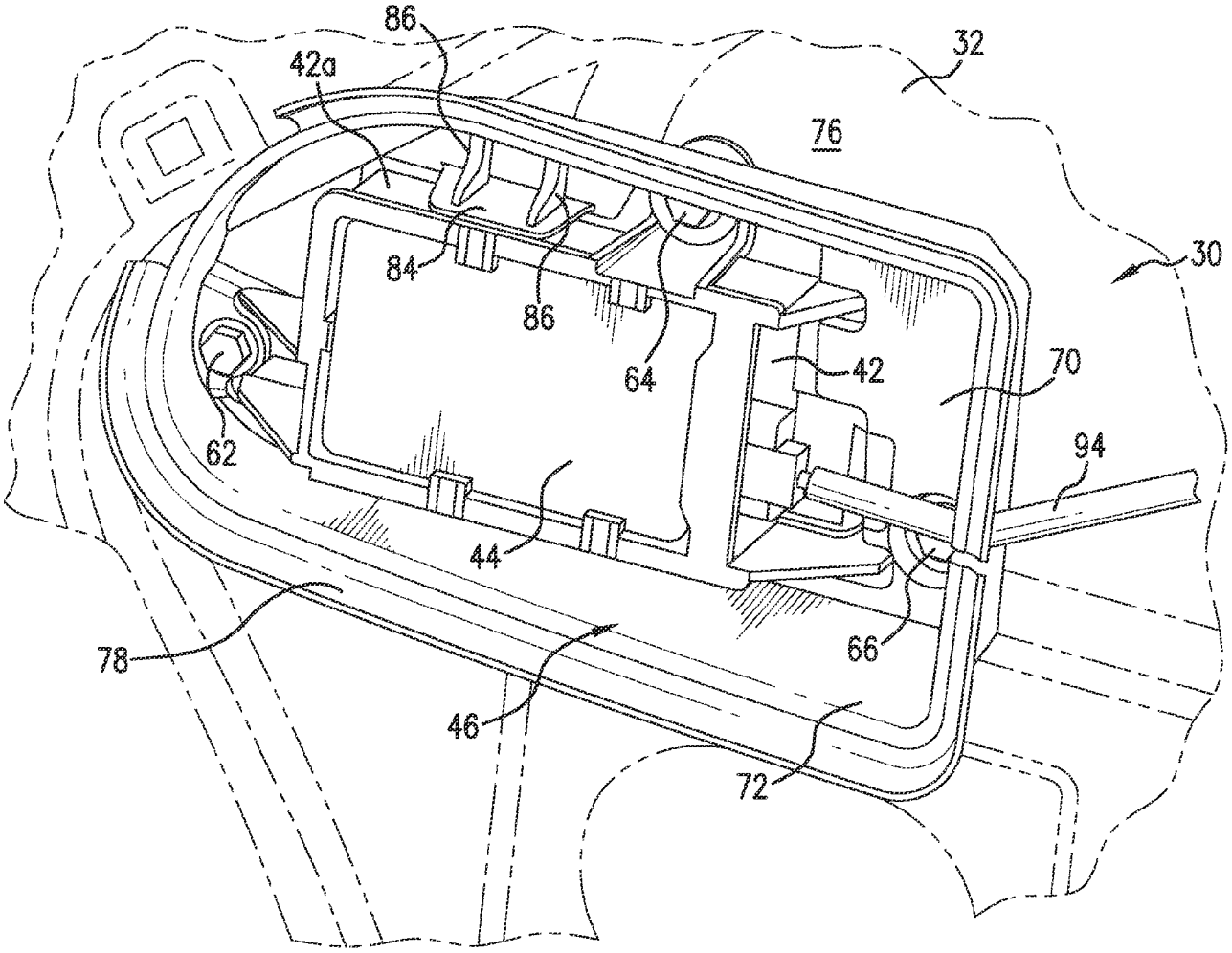
FIG. 2 is an enlarged perspective view of the left-side radar cover assembly of FIG. 1 installed on the vehicle.
Figure 3:
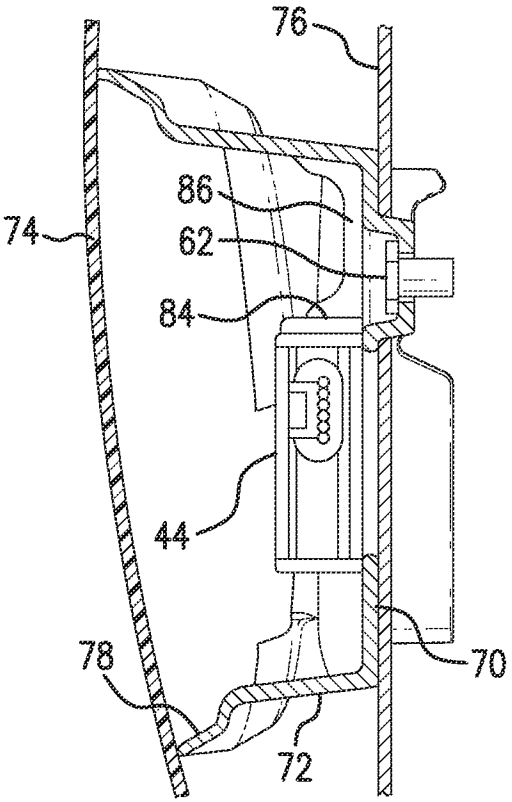
FIG. 3 is a cross-sectional view of the radar cover assembly of FIG. 2.

Referring now to the remaining drawings, wherein the showings are for purposes of illustrating one or more exemplary embodiments and not for purposes of limiting the same, FIGS. 1-3 show a radar cover assembly 30 for a vehicle 32 (schematically illustrated) according to one exemplary embodiment. As shown, the radar cover assembly 30 can be mounted to the vehicle 32 at a location adjacent a rear 34 of the vehicle 32 along a lateral side 36 of the vehicle 32. In particular, in the illustrated embodiment, the radar cover assembly 30 is secured to the vehicle 30 with the side 36 being the left side of the vehicle 32. Also in the illustrated embodiment, the radar cover assembly 30 is a first radar cover assembly and the vehicle 32 includes a second radar cover assembly 38 secured thereto on an opposite lateral side 40 of the vehicle 32. Further details will be discussed in association with the first radar cover assembly 30 but it is to be appreciated by those skilled in the art that such details are applicable to the second radar cover assembly 38. The primary difference between the first and second radar cover assemblies 30, 38 is that the second radar cover assembly 38 is mirrored relative to the first cover assembly 30.

The radar cover assembly 30 includes a radar bracket 42 for securing a radar unit 44 to the vehicle 32 and a radar cover 46 for inhibiting undesirable matter from interfering with the radar unit 44. Undesirable matter can include any matter, such are particulate matter or debris, including snow, mud, dirt, etc. As will be described in more detail below, the radar bracket 42 includes at least one bracket mounting aperture (i.e., one or more mounting apertures) to facilitate mounting of the radar bracket 42 to the vehicle 32 (e.g., see FIG. 8 wherein the radar bracket 42 is shown having three bracket mounting apertures 50, 52, 54). Similarly, the radar cover 46 includes at least one cover mounting aperture (i.e., one or more cover mounting apertures) to facilitate mounting of the radar cover 46 to the vehicle 32 (e.g., see FIG. 4 wherein the radar cover 46 is illustrated having three cover mounting apertures 56, 58, 60).

As best shown in FIG. 2, the radar cover assembly 30 can additionally include at least one fastener (i.e., one or more fasteners) securing both the radar bracket 42 and the radar cover 46 to the vehicle (e.g., fastener 62, 64, 66). Each at least one fastener is received through aligned ones of the at least one bracket mounting aperture and the at least one cover mounting aperture. Accordingly, by this arrangement, each of the at least one mounting apertures is in registry with a corresponding one of the at least one cover apertures for receipt of one of the fasteners.

More particularly, as shown, the radar cover 46 includes a base wall 70 mounted against the vehicle 14 and a peripheral wall 72 extending from the base wall 70 in a direction approximately perpendicular to a general plane of the base wall 70. Together, the base wall 70 and the peripheral wall 72 form a cup-shape that envelops (at least partially) the radar unit 44. In particular, and as best shown in FIG. 3, the peripheral wall 72 extends from the base wall 70 to a bumper member or cover 74 secured to the vehicle 14 over the radar bracket 42, the radar unit 44 and the radar cover 46. In particular, the base wall 70 is mounted in abutting relation against a vehicle body understructure surface 76 of the vehicle 14 over which the bumper member 74 is disposed. The understructure surface 76 can also be referred to as an underside vehicle surface as it is generally not an exposed surface on the vehicle 14 once the bumper member 74 is mounted to the vehicle 14. The peripheral wall 72 extends a varying distance from the base wall 70 to match a varying contour of the bumper member 74. As shown, a distal portion 78 of the peripheral wall 72 can include a flared profile for better sealing against the bumper member 74 disposed over the radar bracket 42 and radar cover 46.

Figure 4:
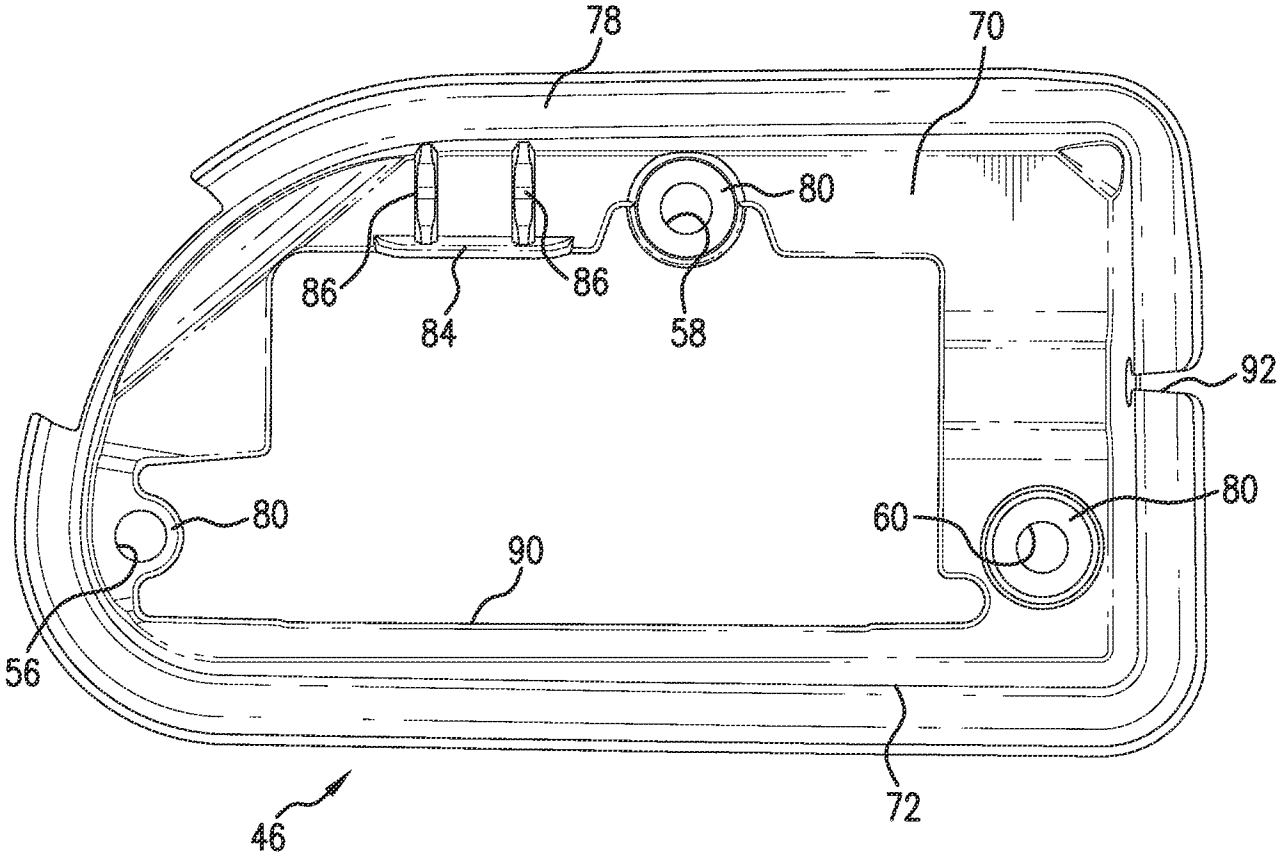
FIG. 4 is a front elevation view of a radar cover from the radar cover assembly of FIG. 2.
Figure 5:
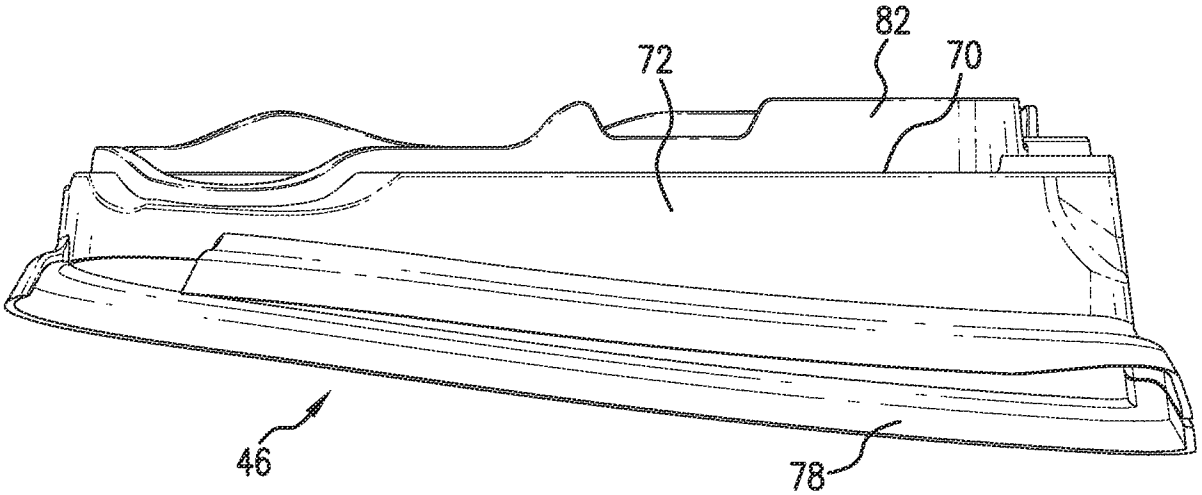
FIG. 5 is a top plan view of the radar cover of FIG. 4.
Figure 7:
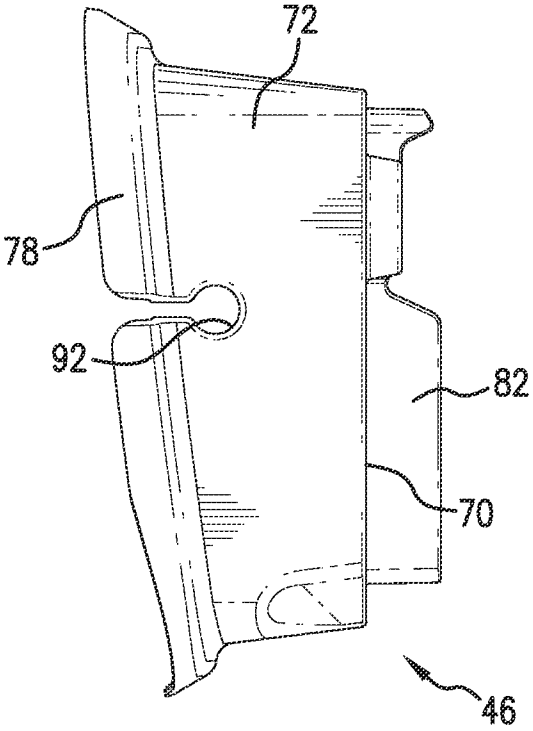
FIG. 7 is a rear end elevation view of the radar cover of FIG. 4.
Figure 6:
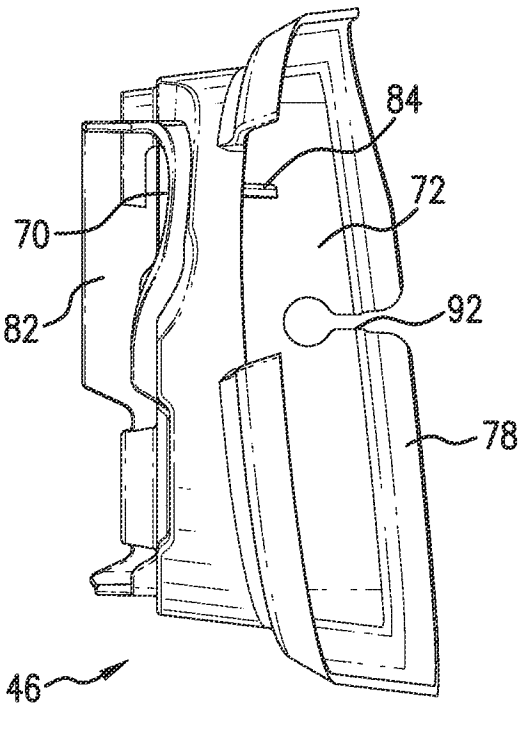
FIG. 6 is a front end elevation view of the radar cover of FIG. 4.
Figure 8:
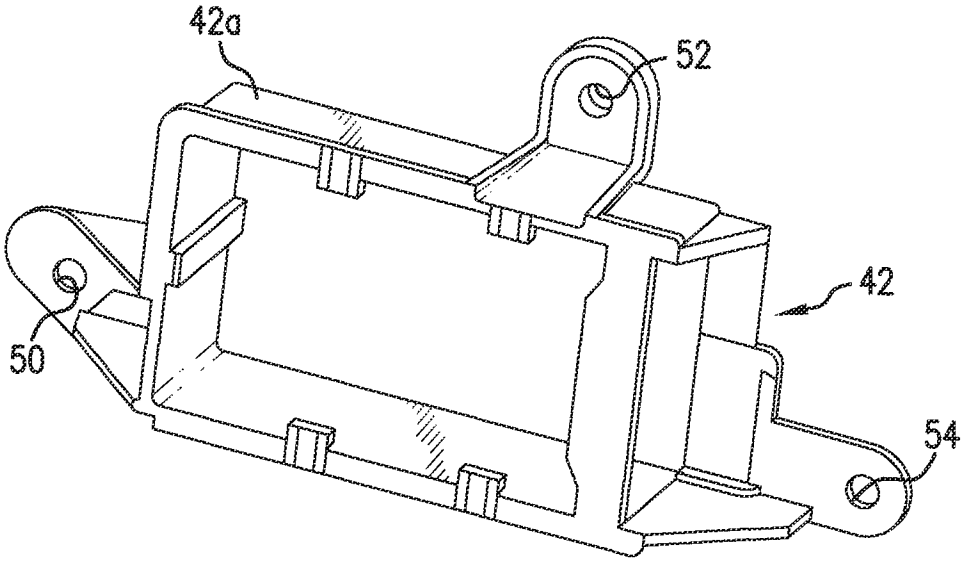
FIG. 8 is a perspective view of a radar bracket from the radar cover assembly of FIG. 2.

In the illustrated embodiment, and as best shown in FIG. 8, the at least one bracket mounting aperture of the radar bracket 42 includes a first bracket mounting hole 50 and a second bracket mounting hole 52. Likewise, and as best shown in FIG. 4, the at least one cover mounting aperture of the radar cover 46 includes a first cover mounting hole 56 and a second cover mounting hole 58. Corresponding to these holes, and as best shown in FIG. 2, the at least one fastener includes a first fastener 62 (e.g., a bolt) received through the first bracket mounting hole 50 and the first cover mounting hole 56 and a second fastener 64 (e.g., a bolt) received through the second bracket mounting hole 52 and the second cover mounting hole 58 to secure both the radar bracket 42 and the radar cover 46 to the vehicle 14 against the surface 76.

In the illustrated embodiment, the at least one bracket mounting aperture further includes a third bracket mounting hole 54 (FIG. 8) and the at least one cover mounting aperture includes a third cover mounting hole 60 (FIG. 4). Likewise, the at least one fastener includes a third fastener 66 (e.g., a bolt, shown in FIG. 2) received through the third bracket mounting hole 54 and the third cover mounting hole 60 to further secure both the radar bracket 42 and the radar cover 46 to the vehicle 14. It is to be appreciated by those skilled in the art that the number of bracket mounting apertures and cover mounting apertures (and the corresponding number of fasteners) can vary from what is depicted in the illustrated embodiment. That is, less than three aligned holes or more than three aligned holes could be used with a corresponding number of fasteners.

With specific reference to FIGS. 4, 5, 6 and 7, the radar cover 46 of the radar cover assembly 30 is shown from various perspectives in isolation. In one embodiment, the radar cover 46 is formed of a flexible plastic material that seals to the bumper member 74 of the vehicle 14 via an interference fit (see FIG. 3) to cover the radar unit 44, together with the underside vehicle surface 76, in all directions except a direction facing the bumper cover 74. For example, the radar cover could be formed from an EPDM material to facilitate structural stability with respect to the radar cover 46 while providing for good sealing between the underside vehicle surface 76 and the bumper cover 74. The radar cover 46 can include a raised embossment portion 80 around each of said at least one cover mounting aperture (i.e., around each hole 56, 58 and 60 in the illustrated embodiment).

The radar cover 46 can additionally include a skirt portion 82 extending from the base wall 70 toward the surface 76 of the vehicle 14 and approximately perpendicular relative to a general plane of the base wall 70. This skirt portion 82 can facilitate sealing of the radar cover 46 with the surface 76 of the vehicle 14, particularly to accommodate for variations and/or surface contour with respect to the surface 76 of the vehicle 14. As best shown in FIGS. 2 and 4, the radar cover 46 can further include a shelf member or portion 84 extending from the base wall 70 in the same direction as the peripheral wall 72 extends from the base wall 70. As shown in FIG. 2, the shelf member 84 can rest against an upper side 42*a* of the radar bracket 42. This can facilitate relative positioning between the radar cover 46 and the radar bracket 42 during assembly of the vehicle 14, particularly during attachment of the radar bracket 42 and the radar cover 46 to the vehicle 14. Reinforcing ribs 86 can be provided in association with the shelf member 84 to provide structural integrity for the shelf member 84.

As shown in FIG. 4, the radar cover 46 can include a bracket receiving aperture 90 defined in the base wall 70 that accommodates the radar bracket 42. Accordingly the radar bracket 42 and the radar unit 44 held by the radar bracket 42 can rest directly against the underside surface 76, though other arrangements could be used (e.g., the base wall 70 could extend beneath the radar unit 42 without any aperture 90 being provided). The radar cover 46 can also include a cut-out area 92 defined in the peripheral wall 72 that accommodates a wired connection 94 to the radar unit 44.

As described above, the fasteners 62, 64, 66 are respectively received through aligned or registered sets of apertures (e.g., apertures 50, 56; apertures 52, 58; and apertures 54, 60) so that each of the fasteners 62, 64, 66 secures both the radar bracket 42 and the radar cover 46 to the underside vehicle surface 76. This provides efficiencies in the manufacturing process in that a single fastener mounts two components, i.e., the radar bracket 42 with the radar unit 44 secured therein and the radar cover 46, to the vehicle. Accordingly, in contrast to the known arrangement of FIG. 11, a single mounting procedure accomplishes the mounting of two components. Additionally, the footprint of the radar cover 46 is much smaller while providing better overall protection to the radar unit 44. In particular, the peripheral wall 72 extends radially around an entirety of the radar bracket 42 and extends axially from the underside vehicle surface 76 to the bumper member 74 arranged over the underside vehicle surface 76. The radar bracket 42 is fully enclosed by the underside vehicle surface 76, the peripheral wall 72 and the bumper member 74.

Figure 9:
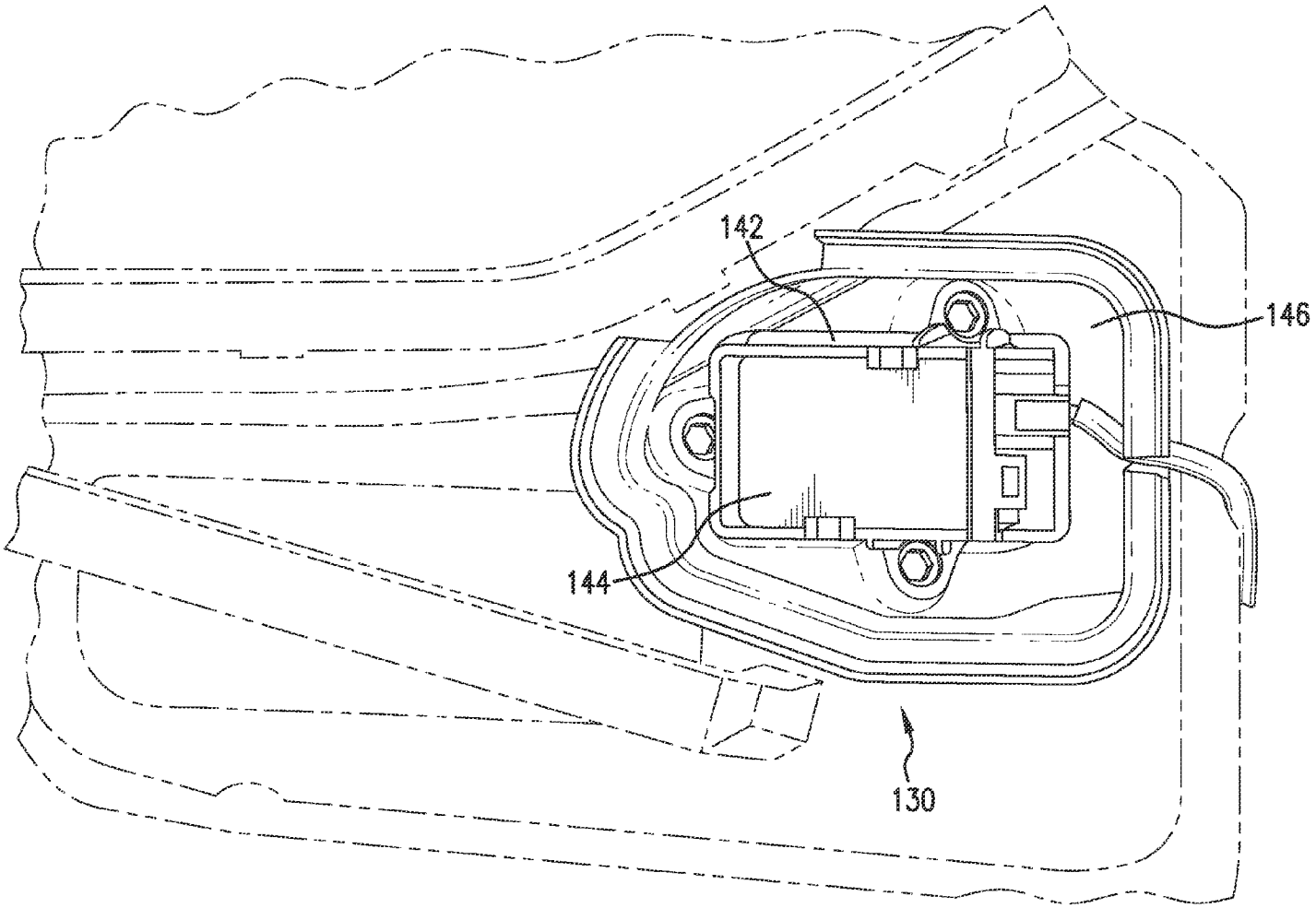
FIG. 9 is an enlarged perspective view of a left-side radar cover assembly installed on a vehicle according to an alternate exemplary embodiment.

With reference now to FIG. 9, a radar cover assembly 130 is shown according to an alternate exemplary embodiment. Except as described herein below, the radar cover assembly 130 can be the same or similar as the radar cover assembly 30 described above. In particular, the radar cover assembly 130 can include a radar bracket 142 for securing a radar unit 144 to the vehicle and a radar cover 146 for covering the radar bracket 142 and the radar unit 144. Generally, one distinguishing feature of the radar cover 146 relative to the radar cover 46 of the assembly 30 is that it has a larger footprint and thus a different shape. It is to be appreciated that various shapes can be used and such shapes can be selected to best complement the vehicle on which the radar cover assembly is to be mounted.

With reference now to FIG. 10, a vehicle radar cover method will be described. In particular, the method will be described in association with the radar cover assembly 30 described herein, though it is to be appreciated by those skilled in the art that the method could be used with other radar cover assemblies. As shown, radar bracket 42 is first provided at S100 to secure radar unit 44 to vehicle underside surface 76. The radar bracket 42 includes at least one bracket mounting aperture, such as the holes 50, 52, 54. As shown at S102, radar cover 46 is also provided. In particular, the radar cover 46 is provided for inhibiting undesirable matter from interfering with the radar unit 44. The radar cover 46 includes at least one cover mounting aperture, such as holes 56, 58, and 60. With the radar bracket 42 provided and the radar cover 46 provided, a fastener (such as one of fasteners 62, 64 and 66) is installed at S104 through aligned ones of the at least one bracket mounting aperture (i.e., holes 50, 52, 54) and the at least one cover mounting aperture (holes 56, 58, 60) to simultaneously secure both the radar bracket 42 and the radar cover 46 to the underside vehicle surface 76.

Again, as already described hereinabove, this provides efficiencies in manufacture in that a single fastener serves the dual function of mounting the radar bracket 42 and the radar cover 46 to the vehicle 14. Once the radar bracket 42 and the radar cover 46 are secured to the vehicle 14, the bumper member 76 can be mounted to the vehicle 14 as indicated at S106. In particular, the bumper member 76 is mounted to the vehicle 14 over the radar bracket 42, the radar unit 44 and the radar cover 46. The radar cover 46 advantageously seals between the underside surface 76 and the bumper member 74.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A radar cover assembly for a vehicle, comprising:

a radar bracket for securing a radar unit to the vehicle, the radar bracket including at least one bracket mounting aperture;

a radar cover for inhibiting undesirable matter from interfering with the radar unit, the radar cover including at least one cover mounting aperture, wherein the radar cover includes:

a base wall mounted against the vehicle, and a peripheral wall extending from the base wall in a direction approximately perpendicular to a general plane of the base wall, the peripheral wall spaced apart from and not covering the radar bracket and the radar unit, the peripheral wall extends outwardly past the radar bracket and radar unit into direct contact with a bumper member secured to the vehicle; and at least one fastener securing both the radar bracket and the radar cover to the vehicle, the at least one fastener received through aligned ones of the at least one bracket mounting aperture and the at least one cover mounting aperture.

2. The radar cover assembly of claim 1 wherein the bumper member covers the radar bracket, the radar unit and the radar cover, and the peripheral wall fully encircling the radar unit.

3. The radar cover assembly of claim 2 wherein the base wall is mounted in abutting relation against a vehicle body understructure surface over which the bumper member is disposed.

4. The radar cover assembly of claim 2 wherein the peripheral wall extends a varying distance from the base wall to match a varying contour of the bumper member.

5. The radar cover assembly of claim 1 wherein the radar cover further includes:

a shelf member extending from the base wall in said direction, the shelf member resting against an upper side of the radar unit.

6. The radar cover assembly of claim 1 wherein a distal portion of the peripheral wall includes a flared profile that seals against the bumper member disposed over the radar bracket and the radar cover.

7. The radar cover assembly of claim 1 wherein the at least one bracket mounting aperture includes a first bracket mounting hole and a second bracket mounting hole, the at least one cover mounting aperture includes a first cover mounting hole and a second cover mounting hole, and the at least one fastener includes a first fastener received through the first bracket mounting hole and the first cover mounting hole and a second fastener received through the second bracket mounting hole and the second cover mounting hole to secure both the radar bracket and the radar cover to the vehicle.

8. The radar cover assembly of claim 7 wherein the at least one bracket mounting aperture includes a third bracket mounting hole, the at least one cover mounting aperture includes a third cover mounting hole and the at least one fastener includes a third fastener received through the third bracket mounting hole and the third cover mounting hole to further secure both the radar bracket and the radar cover to the vehicle.

9. The radar cover assembly of claim 1 wherein the radar cover is formed of a flexible plastic material that seals to the bumper member of the vehicle via an interference fit to cover the radar unit in all directions except a direction facing the bumper cover.

10. The radar cover assembly of claim 1 wherein the radar cover includes a raised embossment portion around each of said at least one cover mounting aperture.

11. The radar cover assembly of claim 1 wherein each of the at least one bracket mounting aperture is in registry with a corresponding one of the at least one cover mounting aperture for receipt of the at least one fastener, and the at least one fastener extends through the at least one bracket mounting aperture and the at least one cover mounting aperture and into a vehicle body understructure of the vehicle.

12. A vehicle radar cover assembly, comprising:

a radar bracket having one or more mounting apertures for securing a radar unit to an underside vehicle surface;

a cup-shaped radar cover having one or more cover mounting apertures for securing the radar cover to the underside vehicle surface, wherein the radar cover further includes a base wall mounted in abutting relation against the underside vehicle surface and a peripheral wall extending outwardly from the base wall; and one or more fasteners received through the one or more mounting apertures, through the one or more cover mounting apertures, and through the underside vehicle surface so that each of the one or more fasteners secures both the radar bracket and the radar cover to the underside vehicle surface, wherein the radar bracket is mounted in abutting relation against the base wall, the peripheral wall only surrounds outer sides of the radar bracket and is in direct contact with a bumper member arranged over the underside vehicle surface, and the radar bracket is fully enveloped by the base wall, the peripheral wall and the bumper member.

13. The vehicle radar cover assembly of claim 12 wherein each of the one or more cover mounting apertures is in registry with a corresponding one of the one or more mounting apertures for receipt of one of the one or more fasteners.

14. The vehicle radar cover assembly of claim 12 wherein the radar cover further includes a skirt portion extending from the base wall toward the underside vehicle surface to seal the radar cover to the underside vehicle surface around the location of the radar unit.

15. The vehicle radar cover assembly of claim 12 wherein the height of the peripheral wall is variable to align an extent thereof to correspond to a varying distance between the underside vehicle surface and the bumper member.

16. The vehicle radar cover assembly of claim 15 wherein the radar cover is formed of a flexible plastic material and the peripheral wall includes a flared distal portion for sealing against the bumper member.

17. A vehicle radar cover method, comprising:

providing a radar bracket for securing a radar unit to a vehicle underside surface, the radar bracket including at least one bracket mounting aperture;

providing a radar cover for inhibiting undesirable matter from interfering with the radar unit, the radar cover including at least one cover mounting aperture, wherein the radar cover further includes a base wall mounted against the vehicle underside surface and a peripheral wall extending outwardly from the base wall away from the vehicle underside surface; and installing a fastener through aligned ones of the at least one bracket mounting aperture and the at least one cover mounting aperture to simultaneously secure both the radar bracket and the radar cover to the underside vehicle surface, wherein the radar bracket is mounted against the base wall and the peripheral wall surrounds but does not cover the radar bracket.

18. The vehicle radar cover method of claim 17 further including:

mounting a bumper member to the vehicle over the radar bracket, the radar unit and the radar cover, the radar cover sealing between the underside surface and the bumper member.

* * * * *